US010210817B2

(12) United States Patent
Zhang et al.

(10) Patent No.: US 10,210,817 B2
(45) Date of Patent: Feb. 19, 2019

(54) DRIVING METHOD AND DRIVING CIRCUIT FOR LIGHT EMITTING DIODE LIGHT SOURCE ASSEMBLY

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Liang Zhang, Beijing (CN); Shuo Li, Beijing (CN); Zhipeng Feng, Beijing (CN); Jianguang Yang, Beijing (CN); Dan Su, Beijing (CN); Zongze He, Beijing (CN); Jieqiong Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/528,888

(22) PCT Filed: Nov. 14, 2016

(86) PCT No.: PCT/CN2016/105653
§ 371 (c)(1),
(2) Date: May 23, 2017

(87) PCT Pub. No.: WO2017/206443
PCT Pub. Date: Dec. 7, 2017

(65) Prior Publication Data

US 2018/0197487 A1 Jul. 12, 2018

(30) Foreign Application Priority Data

May 30, 2016 (CN) ..... 2016 1 0371672

(51) Int. Cl.
*G09G 3/34* (2006.01)
*G09G 3/32* (2016.01)

(52) U.S. Cl.
CPC ..... *G09G 3/3406* (2013.01); *G09G 3/342* (2013.01); *G09G 3/32* (2013.01);
(Continued)

(58) Field of Classification Search
CPC .... G09G 3/3406; G09G 3/32; G09G 2380/10; G09G 2320/064; G09G 2310/0264; G09G 2360/144
See application file for complete search history.

(56) References Cited

U.S. PATENT DOCUMENTS

2006/0044286 A1* 3/2006 Kohlhaas ..... G02F 1/13338 345/173
2006/0139245 A1* 6/2006 Sugiyama ..... G09G 3/002 345/60

(Continued)

FOREIGN PATENT DOCUMENTS

CN 201718081 U 1/2011
CN 102262859 A 11/2011

(Continued)

OTHER PUBLICATIONS

International Search Report & Written Opinion dated Mar. 6, 2017 regarding PCT/CN2016/105653.

(Continued)

*Primary Examiner* — Amit Chatly
(74) *Attorney, Agent, or Firm* — Intellectual Valley Law, P.C.

(57) ABSTRACT

The present application discloses a circuit for driving a light emitting diode light source assembly having a plurality of light emitting diode groups, each group having at least one light emitting diode. The circuit includes a processor con- (Continued)

figured to determine a set brightness level, calculate a number of light emitting diode groups required to be on to achieve the set brightness level, and select the number of light emitting diode groups to be turned on at allocated positions in the light emitting diode light source assembly; and a driving sub-circuit configured to turn on the number of light emitting diode groups at the allocated positions. The number of light emitting diode groups is a positive integer N, N is less than a total number of the plurality of light emitting diode groups.

20 Claims, 3 Drawing Sheets

(52) U.S. Cl.
CPC ..... *G09G 2310/0264* (2013.01); *G09G 2320/064* (2013.01); *G09G 2360/144* (2013.01); *G09G 2380/10* (2013.01)

(56) References Cited

U.S. PATENT DOCUMENTS

2008/0224625 A1 9/2008 Greenfeld
2008/0245949 A1 10/2008 Morimoto et al.
2011/0279040 A1 11/2011 Briggs et al.
2011/0292090 A1* 12/2011 Otani ..... G09G 3/342 345/690
2012/0133686 A1 5/2012 Adachi
2013/0016140 A1* 1/2013 Oniki ..... G09G 3/342 345/690
2015/0228250 A1* 8/2015 Chen ..... G09G 5/10 345/690

FOREIGN PATENT DOCUMENTS

CN 102573216 A 7/2012
CN 202998561 U 6/2013
CN 103292293 A 9/2013
CN 103499072 A 1/2014
CN 203784722 U 8/2014
CN 203812540 U 9/2014
CN 105104153 A 12/2015
GB 2465195 A 5/2010

OTHER PUBLICATIONS

First Office Action in the Chinese Patent Application No. 201610371672.2, dated Nov. 29, 2017; English translation attached.
The extended European search report in the European Patent Application No. 16903823.9, dated Oct. 22, 2018.

* cited by examiner

DRIVING METHOD AND DRIVING CIRCUIT FOR LIGHT EMITTING DIODE LIGHT SOURCE ASSEMBLY

CROSS-REFERENCE TO RELATED APPLICATION

This application is a national stage application under 35 U.S.C. § 371 of International Application No. PCT/CN2016/105653, fi1ed Nov. 14, 2016, which claims priority to Chinese Patent Application No. 201610371672.2, filed May 30, 2016, the contents of which are incorporated by reference in the entirety.

TECHNICAL FIELD

The present invention relates to display technology, more particularly, to a circuit for driving a light emitting diode light source assembly and a driving method thereof.

BACKGROUND

A user's experience with electronic devices such as computer systems, tablets, telephones, electronic book readers, game devices, music playing devices and the like is impacted by ambient light brightness. When a brightness level of the display apparatus is 60% higher than that of the ambient light, it often causes discomfort to the user's eyes. For example, the ambient light brightness may fluctuate frequently when a user is driving a vehicle. When the ambient light becomes too bright or too dark, the driver may have difficulties in viewing the display panels in the vehicle (e.g., a center console, a GPS, etc.). If the brightness level of the display apparatus is not adjusted according to the change in ambient light brightness, the ambient light interferes with the driver's viewing experience.

SUMMARY

In one aspect, the present disclosure provides a circuit for driving a light emitting diode light source assembly having a plurality of light emitting diode groups, each group having at least one light emitting diode, comprising a processor configured to determine a set brightness level, calculate a number of light emitting diode groups required to be on to achieve the set brightness level, and select the number of light emitting diode groups to be turned on at allocated positions in the light emitting diode light source assembly; and a driving sub-circuit configured to turn on the number of light emitting diode groups at the allocated positions; wherein the number of light emitting diode groups is a positive integer N, N is less than a total number of the plurality of light emitting diode groups.

Optionally, the circuit further comprises an acquisition sub-circuit configured to acquire a target brightness level for the light emitting diode light source assembly; wherein the processor configured to determine the set brightness level based on the target brightness level.

Optionally, the acquisition sub-circuit comprises a photosensor configured to detect an ambient light brightness level and generate an analog signal representing the ambient light brightness level; and an analog-to-digital converter coupled to the photosensor, configured to convert the analog signal into a digital signal representing the target brightness level; wherein the processor is configured to determine the set brightness level to be in a range of approximately 0.9 times to approximately 1.5 times the ambient light brightness level.

Optionally, the acquisition sub-circuit comprises a memory configured to store a look-up table comprising a plurality of reference scenarios and a plurality of reference target brightness levels corresponding to the plurality of reference scenarios; a querying sub-circuit configured to search the look-up table to determine a matching reference scenario that matches with a real-time scenario, and wherein the processor is configured to assign a reference target brightness level corresponding to the matching reference scenario as the target brightness level.

Optionally, the photosensor is in a peripheral area of the light emitting diode light source assembly.

Optionally, the processor is configured to divide the set brightness level by a brightness level of one of the plurality of light emitting diode groups to obtain a divided value, and round the divided value to obtain a value of N.

Optionally, the processor is configured to select the number of light emitting diode groups to be turned on at randomly allocated positions in the light emitting diode light source assembly; at any moment in a lighting cycle only N light emitting diode groups are turned on; and the number of light emitting diode groups are turned on at least once at the allocated positions in the lighting cycle.

Optionally, the driving sub-circuit comprises a decoder, the processor is configured to select a plurality sets of allocated positions respectively at which a plurality sets of N light emitting diode groups are to be turned on in a lighting cycle; the decoder is configured to turn on N light emitting diode groups in each of the plurality sets of allocated positions one set-by-one set; wherein the plurality of light emitting diode groups are turned on at least once in the lighting cycle; at any moment in the lighting cycle only N light emitting diode groups are turned on; a number of times for each of the plurality of light emitting diode groups being turned on in a lighting cycle is the same; and a duration for each of the plurality of light emitting diode groups being turned on is the same.

Optionally, each of the plurality of light emitting diode groups consists of one light emitting diode.

In another aspect, the present disclosure provides a back light comprising a light emitting diode light source assembly and a circuit described herein coupled to the light emitting diode.

In another aspect, the present disclosure provides a display apparatus comprising a back light described herein.

In another aspect, the present disclosure provides a method for driving a light emitting diode light source assembly having a plurality of light emitting diodes, comprising determining a set brightness level; calculating a number of light emitting diodes required to be on to achieve the set brightness level; selecting the number of light emitting diodes to be turned on at allocated positions in the light emitting diode light source assembly; and turning on the number of light emitting diodes at the allocated positions; wherein the number of light emitting diode groups is a positive integer N, N is less than a total number of the plurality of light emitting diode groups.

Optionally, the method further comprises acquiring a target brightness level for the light emitting diode light source assembly; wherein the set brightness level is determined based on the target brightness level.

Optionally, acquiring the target brightness level comprises detecting an ambient light brightness level; and generating the target brightness level based on the ambient light brightness level.

Optionally, the set brightness level is determined to be in a range of approximately 0.9 times to approximately 1.5 times the ambient light brightness level.

Optionally, acquiring the target brightness level is performed based on a look-up table comprising a plurality of reference target brightness levels corresponding to a plurality of reference scenarios, comprising acquiring a real-time scenario; searching the look-up table to determine a matching reference scenario; and assigning a reference target brightness level corresponding to the matching reference scenario as the target brightness level.

Optionally, N is a number rounded from a value obtained by dividing the set brightness level by a brightness level of one of the plurality of light emitting diodes.

Optionally, the allocated positions are randomly allocated positions; at any moment in a lighting cycle only N light emitting diodes are turned on; and the number of light emitting diodes are turned on at least once at the allocated positions in the lighting cycle.

Optionally, the light emitting diode light source assembly comprises a plurality of regions; the method comprising selecting the number of light emitting diodes to be turned on in each of the plurality of regions; and turning on the number of light emitting diodes in each of the plurality of regions one region-by-one region; at any moment in a lighting cycle only N light emitting diodes are turned on; in each of the plurality of regions the number of light emitting diodes are turned on at least once at the allocated positions in the lighting cycle.

Optionally, the method comprises selecting a plurality sets of allocated positions respectively at which a plurality sets of N light emitting diodes are to be turned on in a lighting cycle; and turning on N light emitting diodes in each of the plurality sets of allocated positions one set-by-one set; wherein the plurality of light emitting diodes are turned on at least once in the lighting cycle; at any moment in the lighting cycle only N light emitting diodes are turned on; a number of times for each of the plurality of light emitting diodes being turned on in a lighting cycle is the same; and a duration for each of the plurality of light emitting diodes being turned on is the same.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

When a user is viewing image display in a display apparatus, viewing experience may be affected by ambient light brightness. When a brightness level of the display apparatus is 60% higher than that of the ambient light, it can cause discomfort to the user's eyes. For example, the ambient light brightness fluctuates a lot when a user is driving a vehicle. If the brightness level of the display apparatus is not adjusted according to the change in ambient light brightness, the ambient light interferes with the driver's viewing experience.

Figure 1:
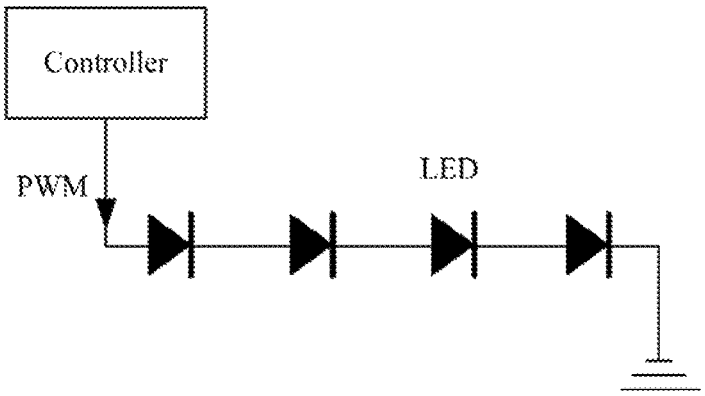
FIG. 1 Related Art
FIG. 1 is a diagram illustrating the structure of a conventional light emitting diode light source driving circuit.
Figure 2:
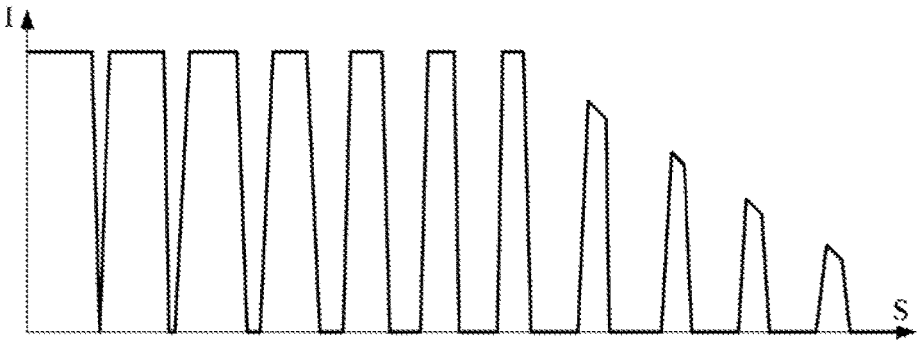
FIG. 2 Related Art
FIG. 2 is a diagram illustrating a driving current in a conventional light emitting diode light source.

FIG. 1 is a diagram illustrating the structure of a conventional light emitting diode light source driving circuit. FIG. 2 is a diagram illustrating a driving current in a conventional light emitting diode light source. Referring to FIGS. 1 and 2, the conventional light source adjusts brightness level by adjusting the driving current for the light source. For example, as shown in FIG. 2, the brightness level of the light source may be adjusted by changing a duty cycle of the driving current. When the ambient light has an increased brightness level, the driving current and the brightness level of the light source for a display apparatus may be decreased using a pulse width modulation signal having a certain duty cycle value. The pulse width modulation method involves all light emitting diodes in the light source, e.g., the brightness levels of every light emitting diode in the light source is adjusted upwards or downwards simultaneously. The brightness level of the light source can only be adjusted in a relatively narrow range. When the driving current is decreased below a certain level, color shift occurs in image display, affecting display quality. Moreover, the display panel is frequently switched between a bright state and a dark state, resulting in flicker. These defects not only affect user viewing experience, but are also harmful to eyesight of a user.

Accordingly, the present invention provides, inter alia, a circuit for driving a light emitting diode light source assembly and a driving method thereof that substantially obviate one or more of the problems due to limitations and disadvantages of the related art. In one aspect, the present disclosure provides a circuit for driving a light emitting diode light source assembly having a plurality of light emitting diode groups, each group having at least one light emitting diode. In some embodiments, the circuit includes a processor configured to determine a set brightness level, calculate a number of light emitting diode groups required to be on to achieve the set brightness level, and select the number of light emitting diode groups to be turned on at allocated positions in the light emitting diode light source assembly; and a driving sub-circuit configured to turn on the number of light emitting diode groups at the allocated positions. Optionally, the circuit further includes an acquisition sub-circuit configured to acquire a target brightness level for the light emitting diode light source assembly, and the processor configured to determine the set brightness level based on the target brightness level.

Figure 3:
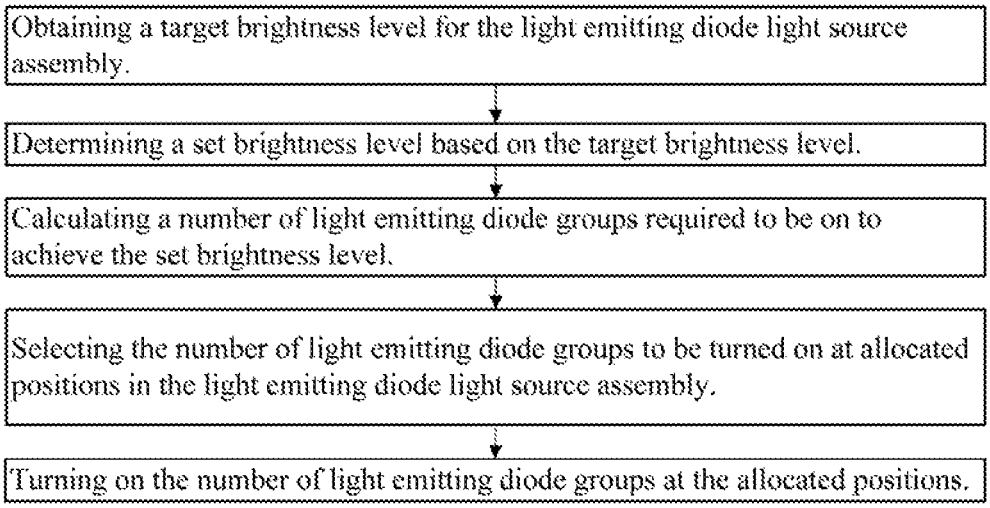
FIG. 3 a flow chart illustrating a method of driving a light emitting diode light source assembly having a plurality of light emitting diodes in some embodiments according to the present disclosure.

FIG. 3 a flow chart illustrating a method of driving a light emitting diode light source assembly having a plurality of light emitting diodes in some embodiments according to the present disclosure. Referring to FIG. 3, the method in some embodiments includes determining a set brightness level; calculating a number N of light emitting diodes required to be on to achieve the set brightness level; selecting the number of light emitting diodes to be turned on at allocated positions in the light emitting diode light source assembly; and turning on the number of light emitting diodes at the allocated positions. Optionally, the method further includes obtaining a target brightness level for the light emitting diode light source assembly, the set brightness level is determined based on the target brightness level.

In some embodiments, the step of obtaining the target brightness level includes detecting an ambient light brightness level and obtaining the target brightness level based on the ambient light brightness level. Optionally, the ambient light brightness level is used as the target brightness level. Once the target brightness level is determined, the set brightness level may be determined based on the target brightness level. For example, the set brightness level may be in a range of approximately 0.5 times to approximately 2.0 times the ambient light brightness level, e.g., approximately 0.9 times to approximately 1.5 times the ambient light brightness level. Optionally, the set brightness level is set to be substantially the same as the ambient light brightness level. Optionally, the set brightness level is set at a level that provides a good display contrast to a user's eyes so that viewing experience is not compromised when the ambient light brightness level changes. Optionally, the formula for determining the set brightness level may be adjusted based on a user demand.

In some embodiments, the number N is a positive integer less than the total number of light emitting diodes in the light emitting diode light source assembly. The brightness level provided by the number N of light emitting diodes is substantially the same as the set brightness level. When each of the plurality of the light emitting diodes in an on-state has a substantially the same brightness level, the number N may be obtained by first dividing the set brightness level by a brightness level of one of the plurality of light emitting diodes to obtain a divided value, and then rounding (e.g., rounding up or rounding down) the divided value to obtain the number N of light emitting diodes required to be on to achieve the set brightness level.

Optionally, the light emitting diode light source assembly includes a plurality of light emitting diode groups (e.g., each group including a plurality of light emitting diodes coupled in series). The method includes calculating a number N of light emitting diode groups required to be on to achieve the set brightness level. The brightness level provided by the number N of light emitting diode groups is substantially the same as the set brightness level. When each of the plurality of the light emitting diode groups in an on-state has a substantially the same brightness level, the number N may be obtained by first dividing the set brightness level by a brightness level of one of the plurality of light emitting diode groups to obtain a divided value, and then rounding (e.g., rounding up or rounding down) the divided value to obtain the number N of light emitting diode groups required to be on to achieve the set brightness level.

In some embodiments, the allocated positions are randomly allocated positions in the light emitting diode light source assembly. At any moment during a lighting cycle, only the number N of light emitting diodes are turned on. Optionally, in a lighting cycle, the number N of the light emitting diodes at the allocated positions are turned on at least once.

Optionally, the light emitting diode light source assembly includes a plurality of light emitting diode groups (e.g., each group including a plurality of light emitting diodes coupled in series). Optionally, the allocated positions are randomly allocated positions of N light emitting diode groups in the light emitting diode light source assembly. At any moment during a lighting cycle, only the number N of light emitting diode groups are turned on. Optionally, in a lighting cycle, the number N of the light emitting diode groups at the allocated positions are turned on at least once.

In some embodiments, the method includes selecting a plurality sets of allocated positions at which the number of light emitting diodes are to be turned on in a lighting cycle, and turning on the number of light emitting diodes in each of the plurality sets of allocated positions one set-by-one set, e.g., sequentially. Optionally, the plurality of light emitting diodes are turned on at least once in the lighting cycle. Optionally, at any moment in the lighting cycle, only a number N of light emitting diodes are turned on. Optionally, in a lighting cycle, each of the plurality of light emitting diodes is turned on for a same number of times (e.g., M times, M being a positive integer). Optionally, a duration D for each of the plurality of light emitting diodes being turned on is the same. Optionally, D is 1/N of the lighting cycle. By turning on a same number of light emitting diodes at randomly allocated positions at any moment for a same duration, an evenly distributed light from the light source can be achieved.

Optionally, the light emitting diode light source assembly includes a plurality of light emitting diode groups (e.g., each group including a plurality of light emitting diodes coupled in series). Optionally, the method includes selecting a plurality sets of allocated positions at which the number of light emitting diode groups are to be turned on in a lighting cycle, and turning on the number of light emitting diode groups in each of the plurality sets of allocated positions one set-by-one set, e.g., sequentially. Optionally, the plurality of light emitting diode groups are turned on at least once in the lighting cycle. Optionally, at any moment in the lighting cycle, only a number N of light emitting diode groups are turned on. Optionally, in a lighting cycle, each of the plurality of light emitting diode groups is turned on for a same number of times (e.g., M times, M being a positive integer). Optionally, a duration D for each of the plurality of light emitting diode groups being turned on is the same. Optionally, D is 1/N of the lighting cycle.

In some embodiments, the allocated positions are distributed evenly over all regions of the light emitting diode light source assembly. In some embodiments, the allocated positions are limited in one region of the light emitting diode light source assembly. Optionally, the light emitting diode light source assembly includes a plurality of regions. Optionally, the method includes selecting the number N of light emitting diodes to be turned on in each of the plurality of regions; and turning on the number N of light emitting diodes in each of the plurality of regions one region-by-one region. Optionally, at any moment in a lighting cycle only the number N of light emitting diodes are turned on. Optionally, in each of the plurality of regions the number N of light emitting diodes at the allocated positions are turned on at least once in the lighting cycle.

Optionally, the light emitting diode light source assembly includes a plurality of light emitting diode groups (e.g., each group including a plurality of light emitting diodes coupled in series). Optionally, the method includes selecting the number N of light emitting diode groups to be turned on in each of the plurality of regions; and turning on the number N of light emitting diode groups in each of the plurality of regions one region-by-one region. Optionally, at any moment in a lighting cycle only the number N of light emitting diode groups are turned on. Optionally, in each of the plurality of regions the number N of light emitting diode groups at the allocated positions are turned on at least once in the lighting cycle.

In one example, the light emitting diode light source assembly has a lighting cycle of 8 ms (or a frequency of 125 Hz). The light emitting diode light source assembly includes four LED strips, LED1, LED2, LED3, and LED4. The method includes turning on 2 LED strips at any moment of the lighting cycle, during which each LED strip is turned on for a duration of 1 ms. In one example, the four LED strips may be turned on in a randomly order.

In another example, the four LED strips may be turned on accordingly to the following order: (1) turning on LED1 and LED 2 for 1 ms; (2) turning on LED2 and LED 3 for 1 ms; (3) turning on LED3 and LED 4 for 1 ms; (4) turning on LED4 and LED 1 for 1 ms; and (5) repeating (1)-(4) once.

In some embodiments, the step of obtaining the target brightness level is performed based on a look-up table containing a plurality of reference target brightness levels corresponding to a plurality of reference scenarios. Examples of reference scenarios include, but are not limited to, a plurality of time-of-day scenarios. In one example, the look-up table contains a plurality of time-of-day scenarios such as morning, afternoon, and evening, and a plurality of target brightness levels corresponding to the morning scenario, the afternoon scenario, and the evening scenarios. In another example, the look-up table contains a plurality of target brightness levels corresponding to each hours of the day. Optionally, the look-up table contains other scenarios such as weather scenarios, season scenarios, and geographical scenarios, as well as a plurality of reference target brightness levels corresponding to these scenarios. The method optionally includes acquiring a real-time scenario, searching the look-up table to determine a matching reference scenario, and assigning a reference target brightness level corresponding to the matching reference scenario as the target brightness level. The real-time scenario may be acquired by simply inputting scenarios information from, e.g., a clock, a calendar, and satellite information generated or stored in an electronic apparatus coupled to the light emitting diode light source assembly. Optionally, the real-time scenario includes a combination of multiple types of scenarios. In one example, the real-time scenario includes time-of-day, season (or month), weather, and geographical information. Optionally, the reference target brightness level is a range of brightness levels.

In one example, the light emitting diode light source assembly is one for providing light to a display apparatus in a bus. The set brightness level of the light emitting diode light source assembly may be determined to be different values corresponding to different reference scenarios, e.g., a morning scenario, an afternoon scenario, an evening scenario, and optionally in combination with various weather scenarios.

In one example, the method does not include a step of obtaining the target brightness level. For example, the step of determining a set brightness level may be performed directly based on a real-time scenario. Optionally, the method includes acquiring a real-time scenario, searching the look-up table to determine a matching reference scenario, and assigning a reference target brightness level corresponding to the matching reference scenario as the set brightness level.

In one example, the step of determining a set brightness level may be performed based on a user input, e.g., the user may set the brightness level for the light emitting diode light source assembly.

Figure 4:
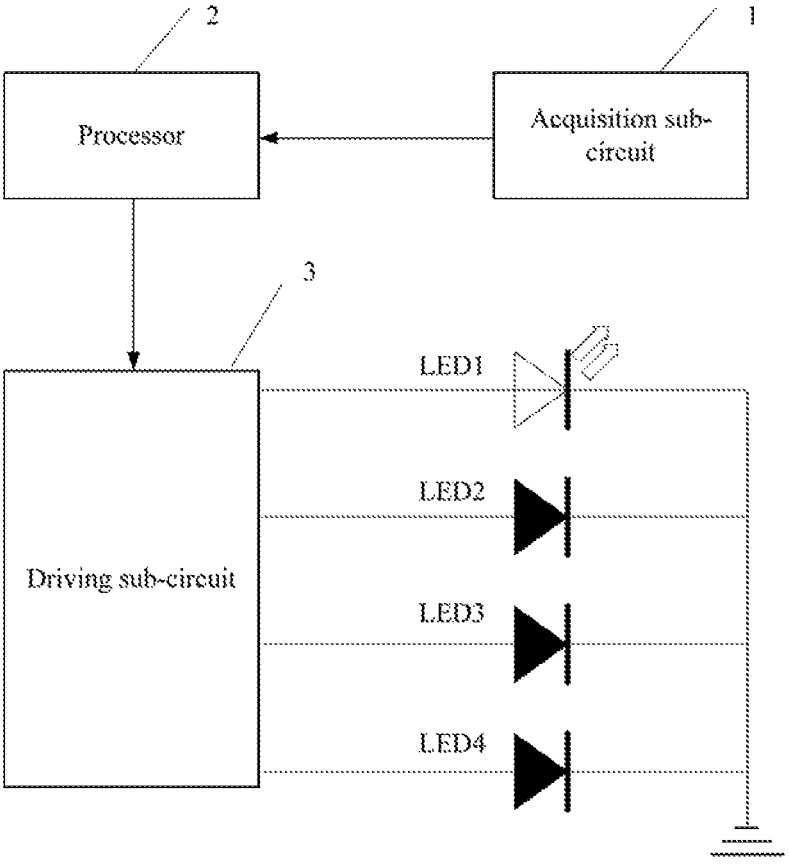
FIG. 4 is a diagram illustrating the structure of a circuit for driving a light emitting diode light source assembly having a plurality of light emitting diodes in some embodiments according to the present disclosure.

FIG. 4 is a diagram illustrating the structure of a circuit for driving a light emitting diode light source assembly having a plurality of light emitting diodes in some embodiments according to the present disclosure. Referring to FIG. 4, the circuit in some embodiments includes a processor 2 configured to determine a set brightness level, calculate a number N of light emitting diodes required to be on to achieve the set brightness level, and select the number N of light emitting diodes to be turned on at allocated positions in the light emitting diode light source assembly, and a driving sub-circuit 3 configured to turn on the number N of light emitting diodes at the allocated positions. Optionally, the circuit further includes an acquisition sub-circuit 1 configured to obtain a target brightness level for the light emitting diode light source assembly, the processor 2 configured to determine the set brightness level based on the target brightness level. Optionally, the driving sub-circuit 3 is configured to provide one or more driving current to the number N of light emitting diodes to turn them on.

In some embodiments, the acquisition sub-circuit 1 includes a photosensor configured to detect an ambient light brightness level and generate an analog signal representing the ambient light brightness level, and an analog-to-digital converter coupled to the photosensor, configured to convert the analog signal into a digital signal representing the target brightness level. The photosensor monitors ambient light brightness level and its change over time continuously. The processor is configured to determine the set brightness level based on the target brightness level. Optionally, the processor is configured to continuously determine the set brightness level based on the target brightness level. Optionally, the processor is configured to determine the set brightness level based on the target brightness level once in every time interval (e.g., once a minute, once an hour). Optionally, the photosensor is in a peripheral area of the light emitting diode light source assembly for detecting ambient light brightness level more accurately. Optionally, the photosensor includes a photosensitive component for sensing light.

In some embodiments, the acquisition sub-circuit 1 detects an ambient light brightness level and determines the target brightness level based on the ambient light brightness level. Optionally, the ambient light brightness level is used as the target brightness level. Once the target brightness level is determined, the processor 2 determines the set brightness level based on the target brightness level. For example, the processor 2 may be configured to determine the set brightness level to be in a range of approximately 0.5 times to approximately 2.0 times the ambient light brightness level, e.g., approximately 0.9 times to approximately 1.5 times the ambient light brightness level. Optionally, the set brightness level is set by the processor 2 to be substantially the same as the ambient light brightness level. Optionally, the set brightness level is set by the processor 2 at a level that provides a good display contrast to a user's eyes so that viewing experience is not compromised when the ambient light brightness level changes. Optionally, the formula for determining the set brightness level may be adjusted based on a user demand.

In some embodiments, the processor 2 includes a brightness level setter, a calculator, and a position allocator. The brightness level setter sets the set brightness level. The calculator calculates the number of light emitting diodes required to be on to achieve the set brightness level. The position allocator allocates positions in the light emitting diode light source assembly at which the number of light emitting diodes are to be turned on.

In some embodiments, the number N is a positive integer less than the total number of light emitting diodes in the light emitting diode light source assembly. The brightness level provided by the number N of light emitting diodes is substantially the same as the set brightness level. In some embodiments, each of the plurality of the light emitting diodes in an on-state has a substantially the same brightness level, the calculator calculates the number N by first dividing the set brightness level by a brightness level of one of the plurality of light emitting diodes to obtain a divided value, and then rounding (e.g., rounding up or rounding down) the divided value to obtain the number N of light emitting diodes required to be on to achieve the set brightness level.

Optionally, the light emitting diode light source assembly includes a plurality of light emitting diode groups (e.g., each group including a plurality of light emitting diodes coupled in series). The calculator calculates a number N of light emitting diode groups required to be on to achieve the set brightness level. The brightness level provided by the number N of light emitting diode groups is substantially the same as the set brightness level. In some embodiments, each of the plurality of the light emitting diode groups in an on-state has a substantially the same brightness level, the calculator calculates the number N by first dividing the set brightness level by a brightness level of one of the plurality of light emitting diode groups to obtain a divided value, and then rounding (e.g., rounding up or rounding down) the divided value to obtain the number N of light emitting diode groups required to be on to achieve the set brightness level.

In some embodiments, the position allocator randomly allocates positions at which the number N of light emitting diodes are to be turned on. At any moment during a lighting cycle, only the number N of light emitting diodes are turned on. Optionally, in a lighting cycle, the number N of the light emitting diodes at the allocated positions are turned on at least once.

Optionally, the light emitting diode light source assembly includes a plurality of light emitting diode groups (e.g., each group including a plurality of light emitting diodes coupled in series). Optionally, the position allocator randomly allocates positions of N light emitting diode groups in the light emitting diode light source assembly. At any moment during a lighting cycle, only the number N of light emitting diode groups are turned on. Optionally, in a lighting cycle, the number N of the light emitting diode groups at the allocated positions are turned on at least once.

In some embodiments, the allocated positions are randomly allocated. Optionally, to ensure an evenly distributed light emission from the light source, each light emitting diode may be switched on and off at a switching frequency. Optionally, the switching frequency is a reciprocal of a duration of each switching-on interval. Optionally, the switching frequency is in a range of approximately 200 Hz to approximately 1000 Hz. In one example, the duration of each switching-on interval is 1 ms, and the switching frequency is 1000 Hz. Optionally, the allocated positions are allocated according to a certain switching frequency.

The processor 2 controls the number of light emitting diodes to be turned on at any given time, thereby setting the brightness level for the light emitted from the light source. By using the present circuit, the light emitting diodes are only switched between an on state and an off state, obviating the color shift issue. Optionally, the present processor 2 is configured to setting the brightness level by a combination of mechanisms. In one example, the processor 2 is configured to control the brightness level by controlling the number of light emitting diodes to be turned on at a given time, by pulse width modulation, by controlling driving currents, or a combination thereof. By doing so, the brightness level may be tuned with a higher accuracy and in a wider range. Optionally, the processor 2 is a monolithic processor.

In some embodiments, the driving sub-circuit 3 includes a decoder. Optionally, the processor is configured to select a plurality sets of allocated positions at which the number of light emitting diodes are to be turned on in a lighting cycle, and the decoder is configured to turn on the number of light emitting diodes in each of the plurality sets of allocated positions one set-by-one set. The decoder is configured to receive signals regarding the number of light emitting diodes to be turned on and the allocated positions, decode the signals, and control the number of light emitting diodes to be turned on at the allocated positions, thereby changing the brightness level of the light source.

Optionally, the plurality of light emitting diodes are turned on at least once in the lighting cycle. Optionally, at any moment in the lighting cycle, only a number N of light emitting diodes are turned on. Optionally, in a lighting cycle, each of the plurality of light emitting diodes is turned on for a same number of times (e.g., M times. M being a positive integer). Optionally, a duration D for each of the plurality of light emitting diodes being turned on is the same. Optionally, D is 1/N of the lighting cycle.

Optionally, the light emitting diode light source assembly includes a plurality of light emitting diode groups (e.g., each group including a plurality of light emitting diodes coupled in series). Optionally, processor is configured to select a plurality sets of allocated positions at which the number of light emitting diode groups are to be turned on in a lighting cycle, and the decoder is configured to turn on the number of light emitting diode groups in each of the plurality sets of allocated positions one set-by-one set, e.g., sequentially. Optionally, the plurality of light emitting diode groups are turned on at least once in the lighting cycle. Optionally, at any moment in the lighting cycle, only a number N of light emitting diode groups are turned on. Optionally, in a lighting cycle, each of the plurality of light emitting diode groups is turned on for a same number of times (e.g., M times, M being a positive integer). Optionally, a duration D for each of the plurality of light emitting diode groups being turned on is the same. Optionally, D is 1/N of the lighting cycle.

In any lighting cycle, the plurality of light emitting diodes (or diode groups) are switching on and off in a high frequency. Thus, the time interval between the on-state and off-state is too small to be sensed by naked eyes, obviating the flicker issue. An evenly distributed light emission from the light source and an extended lift time of the light emitting diodes can be achieved.

In some embodiments, the position allocator is configured to allocate positions (at which the number N of light emitting diodes (or diode groups) to be turned on) evenly over all regions of the light emitting diode light source assembly. In some embodiments, the position allocator is configured to allocate positions (at which the number N of light emitting diodes (or diode groups) to be turned on) limited to one region of the light emitting diode light source assembly.

Optionally, the light emitting diode light source assembly includes a plurality of regions. Optionally, the position allocator is configured to select the number N of light emitting diodes to be turned on in each of the plurality of regions; and the decoder is configured to turn on the number N of light emitting diodes in each of the plurality of regions one region-by-one region. Optionally, at any moment in a lighting cycle only the number N of light emitting diodes are turned on. Optionally, in each of the plurality of regions the number N of light emitting diodes at the allocated positions are turned on at least once in the lighting cycle.

Optionally, the light emitting diode light source assembly includes a plurality of light emitting diode groups (e.g., each group including a plurality of light emitting diodes coupled in series). Optionally, the position allocator is configured to select the number N of light emitting diode groups to be turned on in each of the plurality of regions; and the decoder is configured to turn on the number N of light emitting diode groups in each of the plurality of regions one region-by-one region. Optionally, at any moment in a lighting cycle only the number N of light emitting diode groups are turned on. Optionally, in each of the plurality of regions the number N of light emitting diode groups at the allocated positions are turned on at least once in the lighting cycle.

Figure 5:
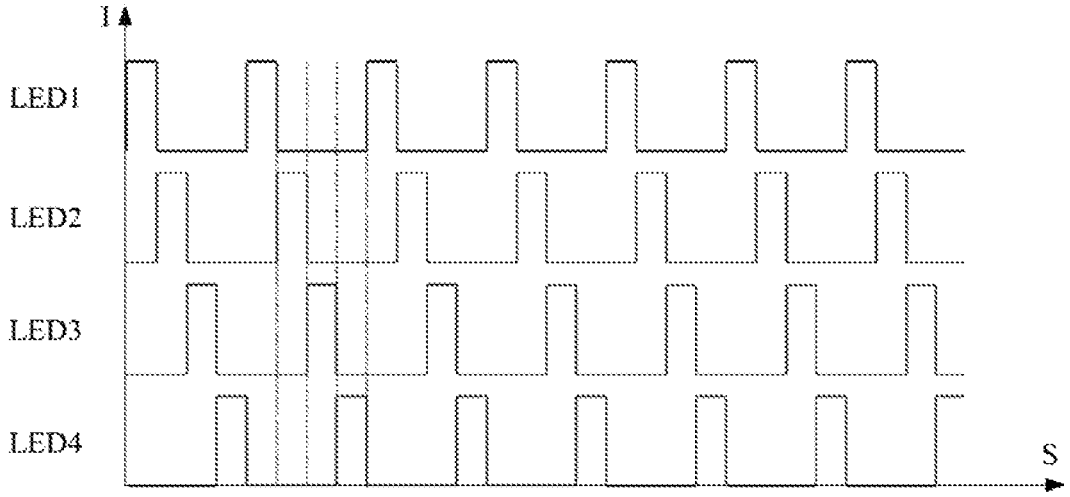
FIG. 5 is a diagram illustrating driving currents in a light emitting diode light source assembly having a plurality of light emitting diodes in some embodiments according to the present disclosure.

In some embodiments, the processor is configured to select a plurality sets of allocated positions at which the number N of light emitting diodes (or diode groups) are turned on, the driving sub-circuit is configured to repeatedly turn on the number N of light emitting diodes (or diode groups) in each of the plurality sets of allocated positions one set-by-one set sequentially. Optionally, the plurality sets of allocated positions are arranged in the light emitting diode light source assembly in a certain order, e.g., in a sequential order. Referring to FIG. 4, the light emitting diode light source assembly includes four LED strips, LED1, LED2, LED3, and LED4. Referring to FIG. 5, a driving current is provided to each LED strip for a duration which is ¼ of a lighting cycle, and each LED strip is turned on for a duration which is ¼ of a lighting cycle. As a result, the brightness level of the light source is ¼ of the light source when all four LED strips are turned on. The switching frequency may be set sufficiently high to eliminate flicker. Moreover, an extended life time of the light source can be achieved.

In some embodiments, the acquisition sub-circuit 1 includes a memory and a querying sub-circuit. The memory is configured to store a look-up table comprising a plurality of reference target brightness levels corresponding to a plurality of reference scenarios. The querying sub-circuit is configured to search the look-up table to determine a matching reference scenario that matches with a real-time scenario. The processor 2 is configured to assign a reference target brightness level corresponding to the matching reference scenario as the target brightness level. Examples of reference scenarios include, but are not limited to, a plurality of time-of-day scenarios. In one example, the look-up table contains a plurality of time-of-day scenarios such as morning, afternoon, and evening, and a plurality of target brightness levels corresponding to the morning scenario, the afternoon scenario, and the evening scenarios. In another example, the look-up table contains a plurality of target brightness levels corresponding to each hours of the day. Optionally, the look-up table contains other scenarios such as weather scenarios, season scenarios, and geographical scenarios, as well as a plurality of reference target brightness levels corresponding to these scenarios. Optionally, the acquisition sub-circuit 1 is configured to acquire a real-time scenario, the querying sub-circuit is configured to search the look-up table to determine a matching reference scenario, and the processor 2 is configured to assign a reference target brightness level corresponding to the matching reference scenario as the target brightness level. The real-time scenario may be acquired by simply receiving scenarios information from, e.g., a clock, a calendar, and satellite information generated or stored in an electronic apparatus coupled to the light emitting diode light source assembly. Optionally, the real-time scenario includes a combination of multiple types of scenarios. In one example, the real-time scenario includes time-of-day, season (or month), weather, and geographical information. Optionally, the reference target brightness level is a range of brightness levels.

In some embodiments, the light emitting diode light source assembly is an illuminating light source for illuminating various indoor or outdoor spaces, including streets, schools, factories, parks, city squares, or courtyards.

In some embodiments, the light emitting diode light source assembly is a back light for a display apparatus. Optionally, the back light includes a light emitting diode light source assembly and a circuit described herein.

In another aspect, the present disclosure provides a display apparatus having a back light described herein. Examples of appropriate display apparatuses includes, but are not limited to, an electronic paper, a mobile phone, a tablet computer, a television, a monitor, a notebook computer, a digital album, a GPS, etc.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A circuit for driving a light emitting diode light source assembly having a plurality of light emitting diode groups, each group having at least one light emitting diode, comprising:

a processor configured to determine a set brightness level, calculate a number of light emitting diode groups required to be on to achieve the set brightness level, the number of light emitting diode groups being a positive integer N, N being less than a total number of the plurality of light emitting diode groups, and select a plurality sets of N light emitting diode groups respectively at a plurality sets of allocated positions to be turned on respectively at different moments in a same lighting cycle; and a driving sub-circuit configured to turn on, one set-by-one set, the plurality sets of N light emitting diode groups respectively at a plurality sets of allocated positions in the same lighting cycle;

wherein the plurality sets of allocated positions are different from each other;

the plurality sets of N light emitting diode groups are different from each other; and at any moment in the same lighting cycle only one set of the plurality sets of N light emitting diode groups at only one set of the plurality sets of allocated positions is turned on.

2. The circuit of claim 1, further comprising an acquisition sub-circuit configured to acquire a target brightness level for the light emitting diode light source assembly;

wherein the processor configured to determine the set brightness level based on the target brightness level.

3. The circuit of claim 2, wherein the acquisition sub-circuit comprises:

a photosensor configured to detect an ambient light brightness level and generate an analog signal representing the ambient light brightness level; and an analog-to-digital converter coupled to the photosensor, configured to convert the analog signal into a digital signal representing the target brightness level;

wherein the processor is configured to determine the set brightness level to be in a range of approximately 0.9 times to approximately 1.5 times the ambient light brightness level.

4. The circuit of claim 2, wherein the acquisition sub-circuit comprises:

a memory configured to store a look-up table comprising a plurality of reference scenarios and a plurality of reference target brightness levels corresponding to the plurality of reference scenarios;

a querying sub-circuit configured to search the look-up table to determine a matching reference scenario that matches with a real-time scenario, and wherein the processor is configured to assign a reference target brightness level corresponding to the matching reference scenario as the target brightness level.

5. The circuit of claim 3, wherein the photosensor is in a peripheral area of the light emitting diode light source assembly.

6. The circuit of claim 1, wherein the processor is configured to divide the set brightness level by a brightness level of one of the plurality of light emitting diode groups to obtain a divided value, and round the divided value to obtain a value of N.

7. The circuit of claim 1, wherein the plurality sets of allocated positions are a plurality sets of randomly allocated positions in the light emitting diode light source assembly;

at any moment in the same lighting cycle only N light emitting diode groups are turned on; and each of the plurality sets of N light emitting diode groups is turned on at least once at a corresponding set of allocated positions of the plurality sets of allocated positions in the same lighting cycle.

8. The circuit of claim 1, wherein wherein each of the plurality of light emitting diode groups is turned on at least once in the same lighting cycle;

at any moment in the same lighting cycle only N light emitting diode groups are turned on;

a number of times for each of the plurality of light emitting diode groups being turned on in a lighting cycle is the same; and a duration for each of the plurality of light emitting diode groups being turned on is the same.

9. The circuit of claim 1, wherein each of the plurality of light emitting diode groups consists of one light emitting diode.

10. A back light, comprising a light emitting diode light source assembly and a circuit of claim 1 coupled to the light emitting diode.

11. A display apparatus, comprising a back light of claim 10.

12. A method for driving a light emitting diode light source assembly having a plurality of light emitting diodes, comprising:

determining a set brightness level;

calculating a number of light emitting diodes required to be on to achieve the set brightness level, the number of light emitting diode groups being a positive integer N, N being less than a total number of the plurality of light emitting diode groups;

selecting a plurality sets of N light emitting diode groups respectively at a plurality sets of allocated positions to be turned on respectively at different moments in a same lighting cycle; and turning on, one set-by-one set, the plurality sets of N light emitting diode groups respectively at a plurality sets of allocated positions in the same lighting cycle;

wherein the plurality sets of allocated positions are different from each other;

the plurality sets of N light emitting diode groups are different from each other; and at any moment in the same lighting cycle only one set of the plurality sets of N light emitting diode groups at only one set of the plurality sets of allocated positions is turned on.

13. The method of claim 12, further comprising acquiring a target brightness level for the light emitting diode light source assembly;

wherein the set brightness level is determined based on the target brightness level.

14. The method of claim 13, wherein acquiring the target brightness level comprises:

detecting an ambient light brightness level; and generating the target brightness level based on the ambient light brightness level.

15. The method of claim 14, wherein the set brightness level is determined to be in a range of approximately 0.9 times to approximately 1.5 times the ambient light brightness level.

16. The method of claim 13, wherein acquiring the target brightness level is performed based on a look-up table comprising a plurality of reference target brightness levels corresponding to a plurality of reference scenarios, comprising:

acquiring a real-time scenario;

searching the look-up table to determine a matching reference scenario; and assigning a reference target brightness level corresponding to the matching reference scenario as the target brightness level.

17. The method of claim 12, wherein N is a number rounded from a value obtained by dividing the set brightness level by a brightness level of one of the plurality of light emitting diodes.

18. The method of claim 12, wherein the plurality sets of allocated positions are a plurality sets of randomly allocated positions;

at any moment in the same lighting cycle only N light emitting diodes are turned on; and each of the plurality sets of N light emitting diode groups is turned on at least once at a corresponding set of allocated positions of the plurality sets of allocated positions in the same lighting cycle.

19. The method of claim 12, wherein the light emitting diode light source assembly comprises a plurality of regions;

the method comprising:

selecting the number of light emitting diodes to be turned on in each of the plurality of regions; and turning on the number of light emitting diodes in each of the plurality of regions one region-by-one region;

at any moment in a lighting cycle only N light emitting diodes are turned on;

in each of the plurality of regions the number of light emitting diodes are turned on at least once at allocated positions in the lighting cycle.

20. The method of claim 12, wherein each of the plurality of light emitting diodes is turned on at least once in the same lighting cycle;

at any moment in the same lighting cycle only N light emitting diodes are turned on;

a number of times for each of the plurality of light emitting diodes being turned on in a lighting cycle is the same; and a duration for each of the plurality of light emitting diodes being turned on is the same.

* * * * *